US010267552B2

(12) United States Patent
Lee

(10) Patent No.: US 10,267,552 B2
(45) Date of Patent: Apr. 23, 2019

(54) MULTI-DUCT AND REFRIGERATOR INCLUDING THE SAME

(71) Applicant: LG ELECTRONICS INC., Seoul (KR)

(72) Inventor: Dong Hyoung Lee, Seoul (KR)

(73) Assignee: LG Electronics, Inc., Seoul (KR)

( * ) Notice: Subject to any disclaimer, the term of this patent is extended or adjusted under 35 U.S.C. 154(b) by 1 day.

(21) Appl. No.: 15/581,127

(22) Filed: Apr. 28, 2017

(65) Prior Publication Data

US 2017/0314842 A1 Nov. 2, 2017

(30) Foreign Application Priority Data

May 2, 2016 (KR) ..... 10-2016-0053910

(51) Int. Cl.

| | |
|---|---|
| ***F25D 17/08*** | (2006.01) |
| ***F25D 17/06*** | (2006.01) |
| ***F25D 25/02*** | (2006.01) |

(52) U.S. Cl.

CPC ..... *F25D 17/08* (2013.01); *F25D 17/062* (2013.01); *F25D 25/02* (2013.01); *F25D 2317/063* (2013.01); *F25D 2317/067* (2013.01); *F25D 2317/0671* (2013.01)

(58) Field of Classification Search

CPC ..... F25D 17/08; F25D 17/062; F25D 25/02; F25D 2317/063; F25D 2317/067; F25D 2317/0671

See application file for complete search history.

(56) References Cited

U.S. PATENT DOCUMENTS

| | | | | |
|---|---|---|---|---|
| 3,004,400 A * | 10/1961 | Mann | F25D 17/065 62/156 |
| 5,921,104 A | 7/1999 | Chang | |
| 7,444,832 B2 * | 11/2008 | Gorz | F25D 17/045 454/305 |

FOREIGN PATENT DOCUMENTS

| | | |
|---|---|---|
| EP | 2950020 A1 | 12/2015 |
| JP | 10292985 A1 | 11/1998 |
| JP | 2001221554 A1 | 8/2001 |
| KR | 10-1998-0047852 | 9/1998 |
| KR | 10-1999-0060422 | 7/1999 |
| WO | WO02081987 A1 | 10/2002 |
| WO | WO2015010455 | 1/2015 |

OTHER PUBLICATIONS

Extended European Search Report in European Application No. 17168961.5, dated Mar. 8, 2018, 13 pages.

* cited by examiner

*Primary Examiner* — Melvin Jones
(74) *Attorney, Agent, or Firm* — Fish & Richardson P.C.

(57) ABSTRACT

A multi-duct that is coupled to a surface of a cabinet including a plurality of spaces divided by one or more shelves in a refrigerator and that includes: a flow channel (i) that extends between a first end of the flow channel and a second end of the flow channel in a first direction, (ii) that passes through the plurality of spaces, and (iii) that guides cool air from the first end to the second end; an inlet; and a plurality of outlets, wherein the flow channel includes a first curved flow channel (i) that is configured to discharge cool air through a first outlet of the plurality of outlets and (ii) that has a concave shape that is curved toward a second direction opposite to a direction in which cool air is discharged through the first outlet is disclosed.

19 Claims, 14 Drawing Sheets

【Fig. 1】
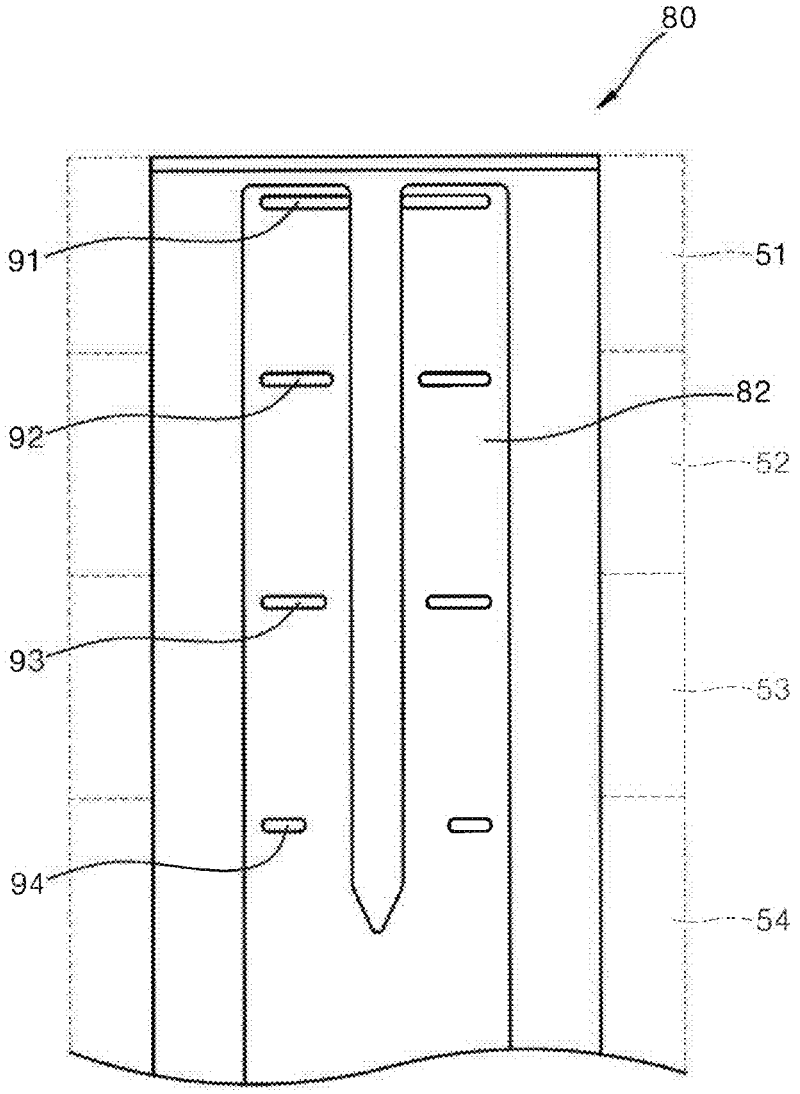

【Fig. 2】
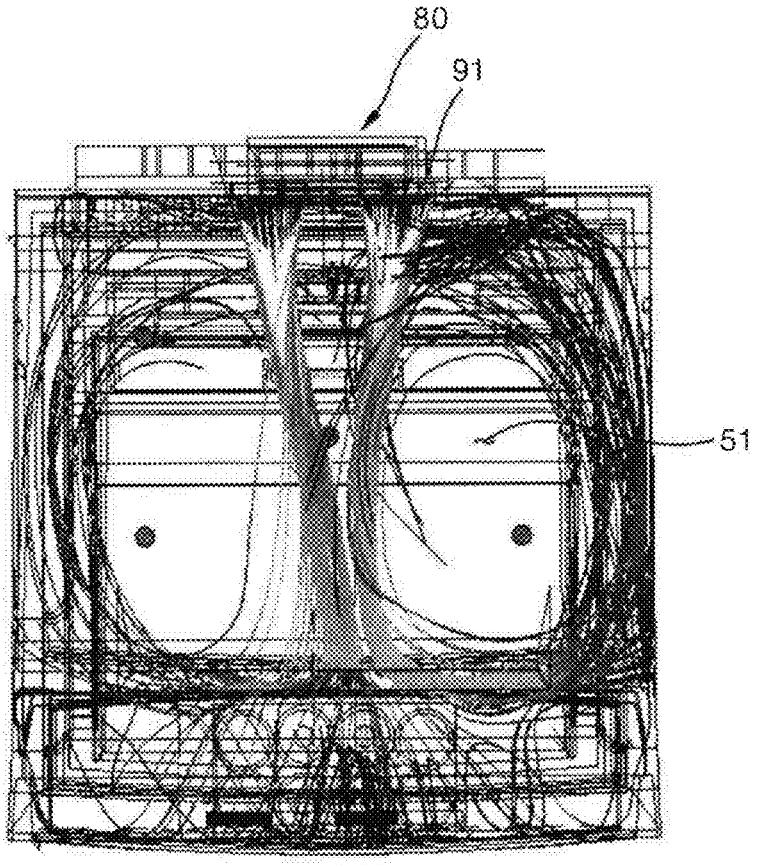

【Fig. 3】
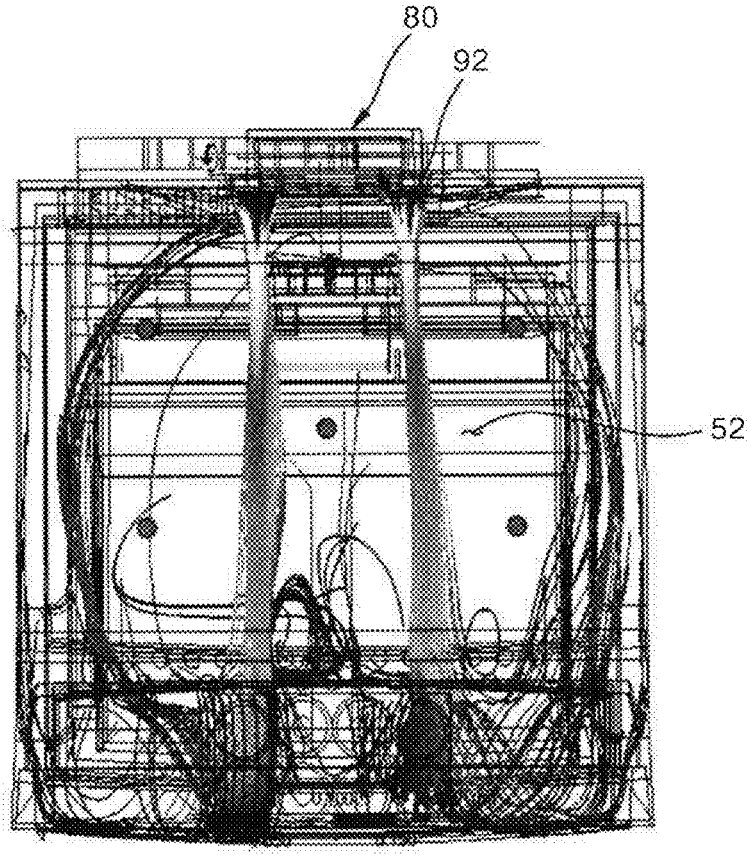

【Fig. 4】
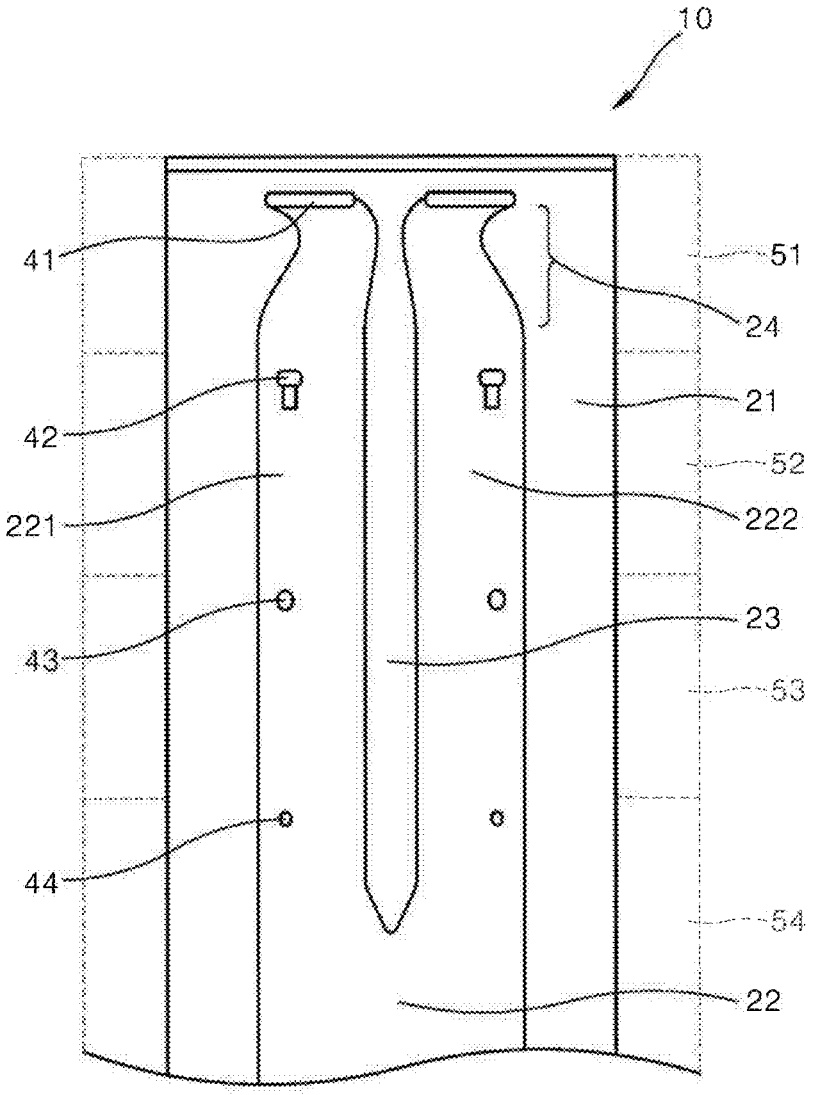

【Fig. 5】
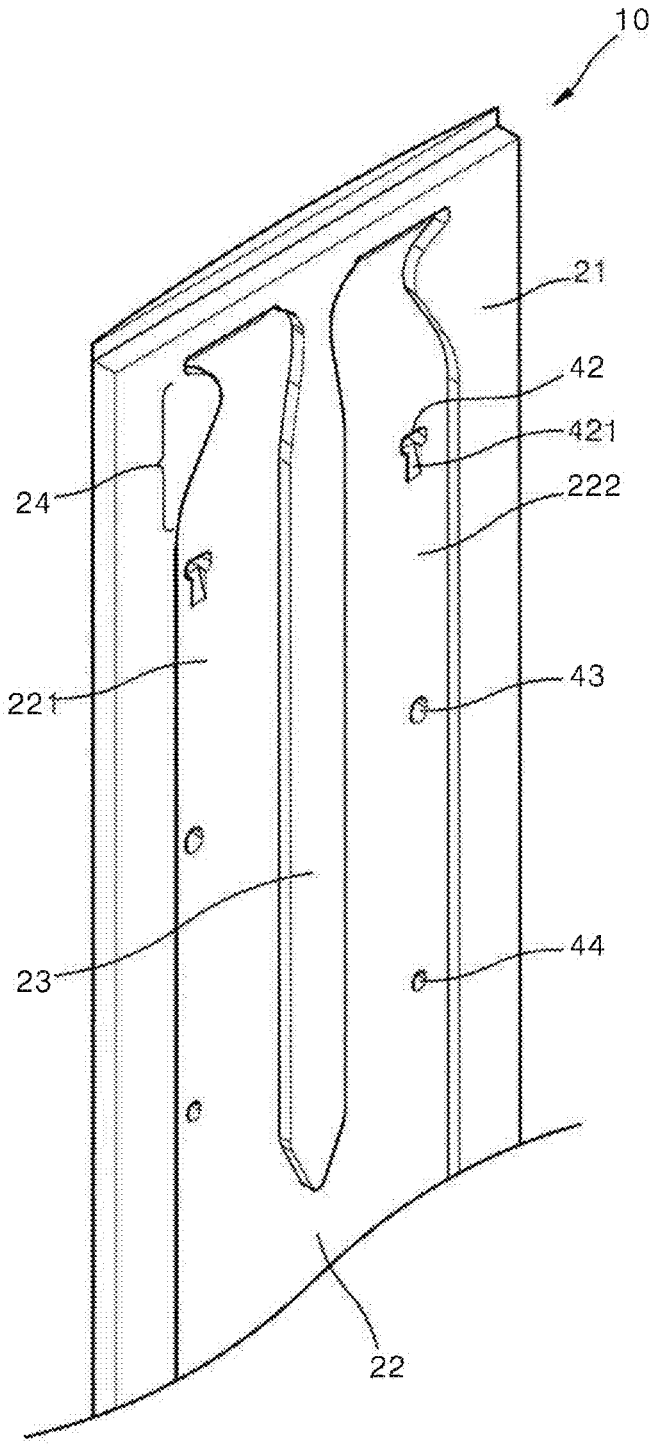

【Fig. 6】
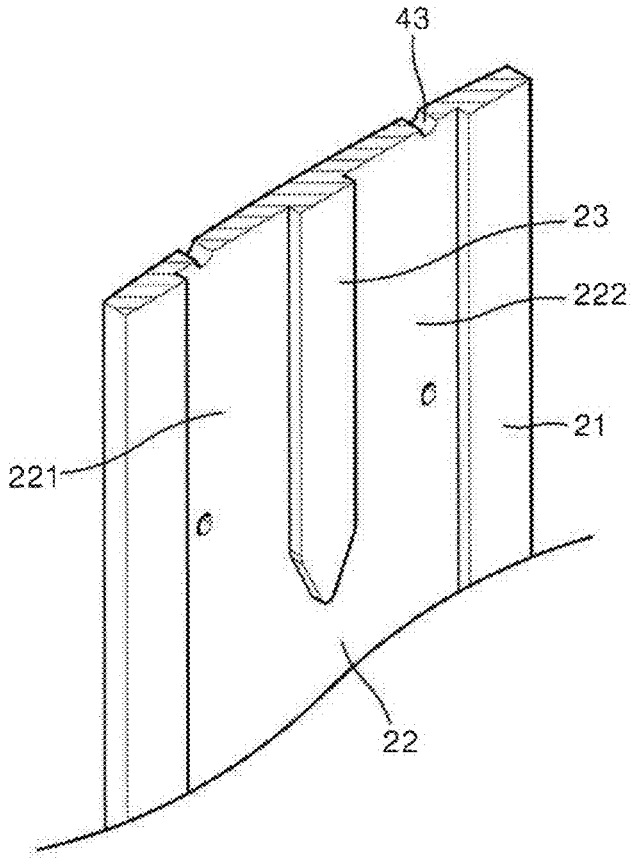

【Fig. 7】
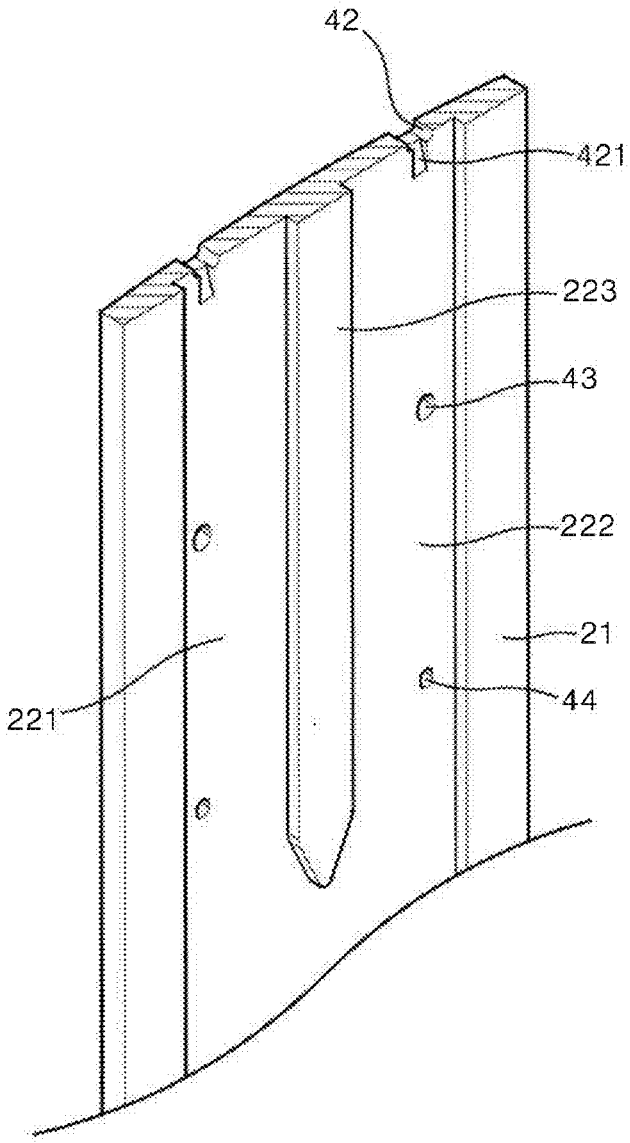

【Fig. 8】
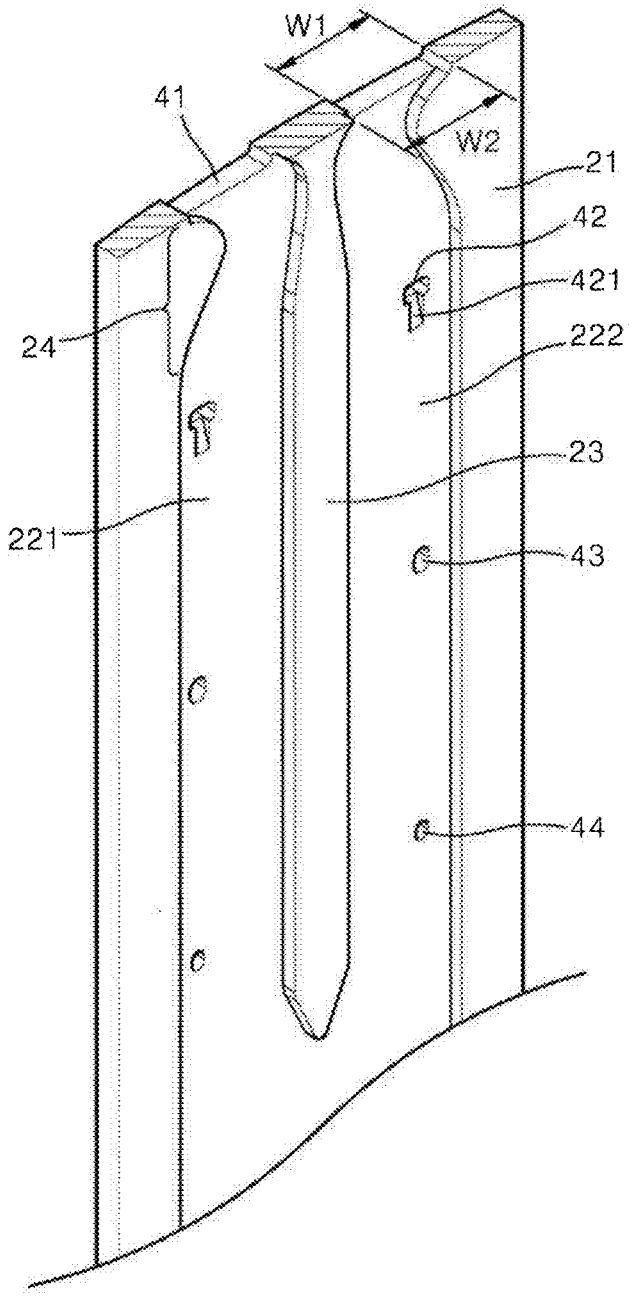

【Fig. 9】
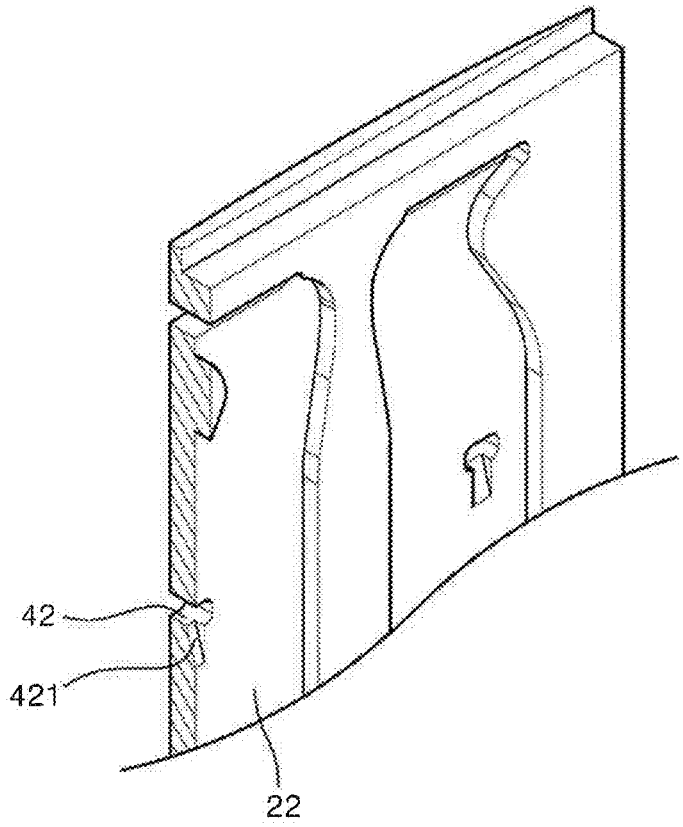

【Fig. 10】
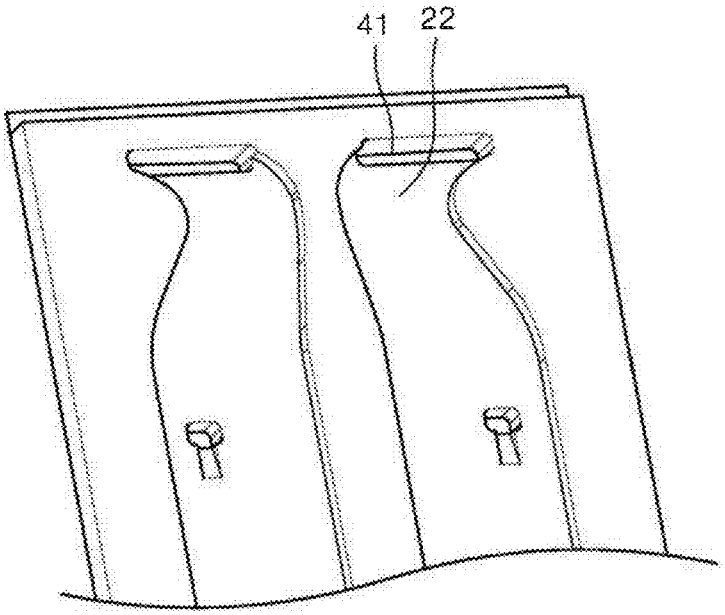

【Fig. 11】
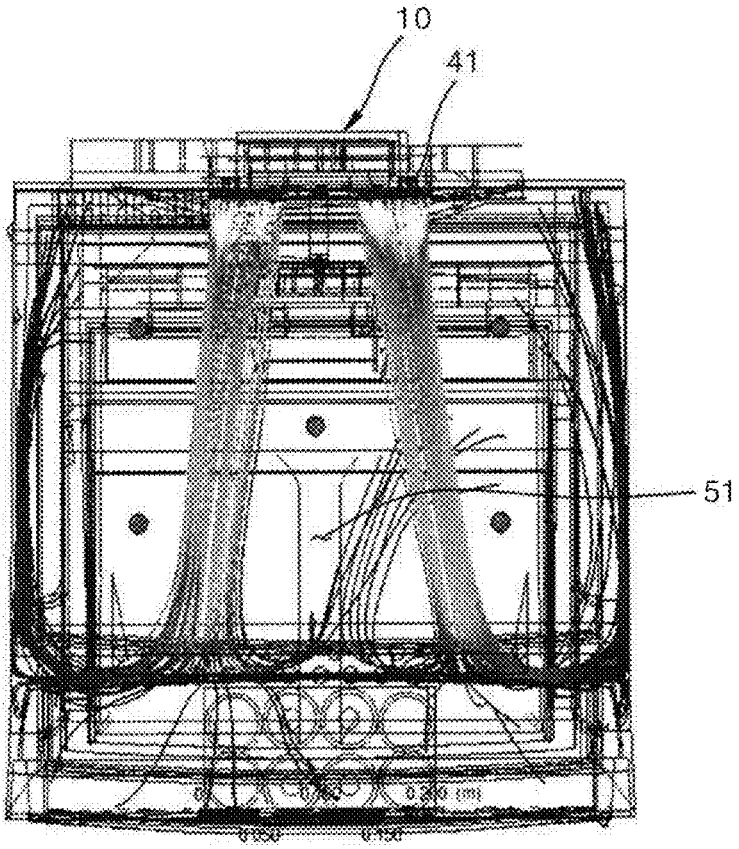

【Fig. 12】
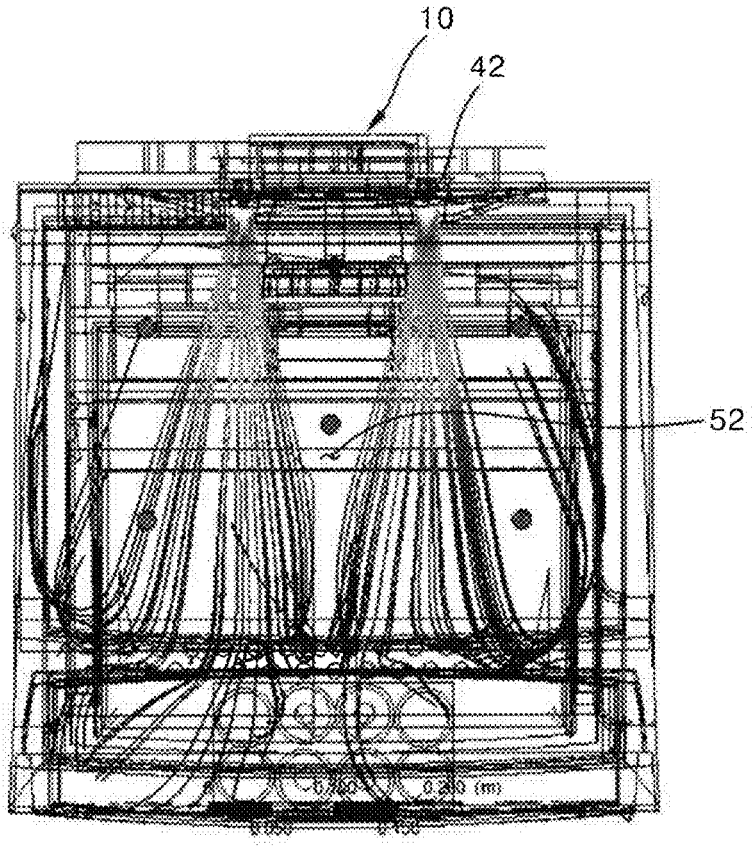

【Fig. 13】
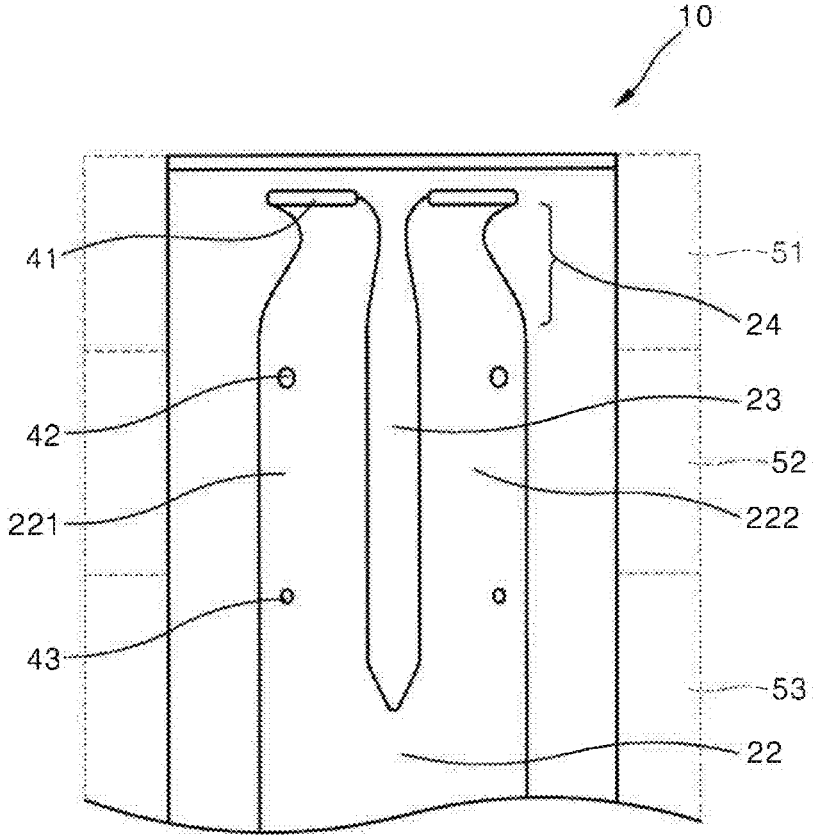

【Fig. 14】
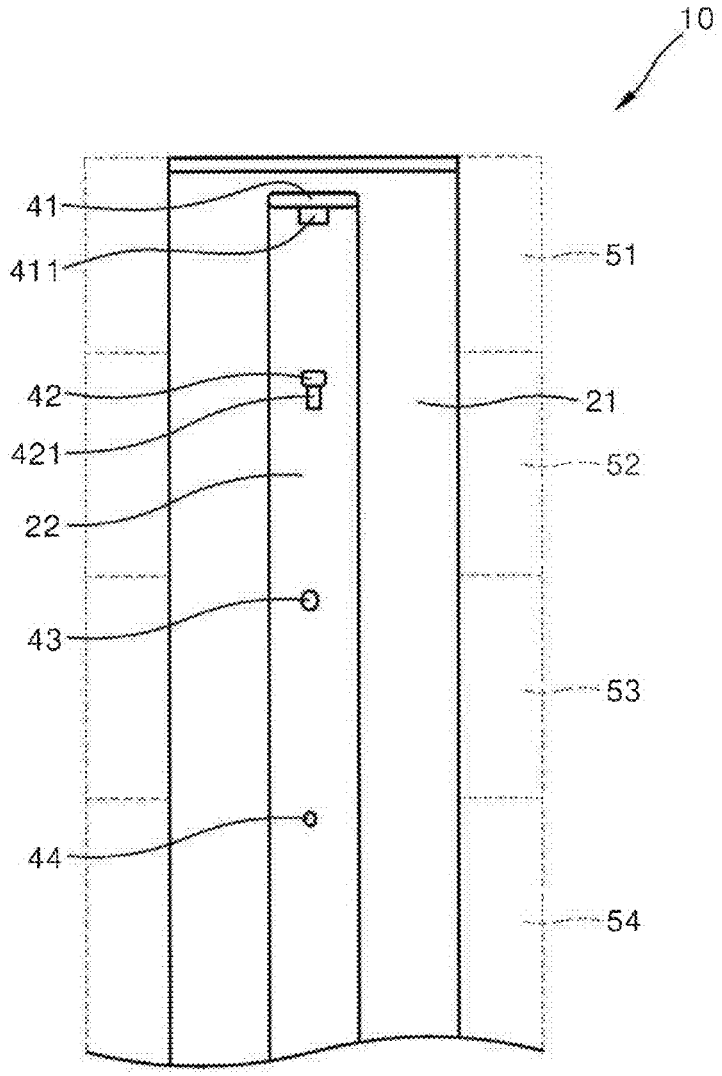

MULTI-DUCT AND REFRIGERATOR INCLUDING THE SAME

CROSS-REFERENCE TO RELATED APPLICATION

This application claims priority to and the benefit of Korean Patent Application No. 10-2016-0053910, filed on May 2, 2016, the entire content of which is hereby incorporated by reference.

TECHNICAL FIELD

The present application relates to technologies about a refrigerator.

BACKGROUND

A refrigerator includes a shelf in an internal space of a cabinet of the refrigerator. A shelf is installed to efficiently use an internal space of a refrigerator. When the shelf is installed, the internal space of the refrigerator is divided into a plurality of spaces with the shelf as a boundary. Particularly, since a shelf including a bottom plate manufactured using glass or a transparent synthetic resin material has a shape with the bottom plate that is closed, it is difficult to expect a smooth air flow between plurality of divided spaces divided by the shelf.

Accordingly, air cooled by an evaporator installed in a refrigerator is forcibly moved to the plurality of divided spaces and is uniformly distributed into each of the divided spaces to cool the internal space of the refrigerator. That is, the air cooled by the evaporator is pressurized by a fan to move through a duct installed on a rear side of an inner wall of a cabinet and to be supplied to each of the divided spaces through outlets formed at intervals in a path of the duct.

FIG. 1 illustrates an example multi-duct coupled to a cabinet of a refrigerator. An internal space of a cabinet of the refrigerator is divided into first to fourth spaces 51, 52, 53, and 54 by shelves. Also, a multi-duct 80 is installed in a center of a rear side of the cabinet of the refrigerator, in a vertically extending shape as shown in the drawing.

A flow channel 82 is provided in the multi-duct 80 in a vertical direction. A lower end of the flow channel is an entrance of the duct and becomes an inlet through which air cooled by a cooling apparatus such as an evaporator installed at a bottom of a rear side of the refrigerator and pressurized by a fan flows. The air that flows from a bottom of the multi-duct moves upward along the flow channel 82 and sequentially flows into the spaces 54, 53, 52, and 51 in the cabinet through outlets 94, 93, 92, and 91, respectively.

FIG. 2 illustrates example flow and speed of air from a first outlet to a first space a refrigerator. In FIG. 2, air is discharged from a first outlet 91 to a first space 51 through the multi-duct 80 of FIG. 1. FIG. 3 illustrates an example flow and speed of air from a second outlet to a second space in a refrigerator. In FIG. 3, air is discharged from a second outlet 92 to a second space 52.

As shown in FIG. 2, the air discharged through the first outlet 91 is discharged less amount despite a large size of the outlet and discharged to be collected at a center of the space. Accordingly, a temperature of a central area of the first space 51 is low but on the other hand, a temperature of a periphery, particularly a rearward periphery, is relatively high. Due to a structure of the first outlet 91 through which the air is discharged to be collected at the center while the velocity of the air is not high, a temperature difference between a central part and a rearward peripheral space in the first space 51 may be high.

Next, as shown in FIG. 3, the air discharged through the second outlet 92 flows at a lower velocity than that of the air discharged through the third and fourth outlets that are present further upstream of the flow but is intensively discharged in a linear shape. Accordingly, the air in the second space 52 is not smoothly mixed and ultimately temperatures of all areas in the space may be uneven and a temperature difference may be increased depending on position.

Also, even though the first outlet 91 and the second outlet 92 have considerable cross sectional areas, temperatures of the first space 51 and the second space 52 are measured to be slightly higher than temperatures of the third space 53 and the fourth space 54.

SUMMARY

In general, one innovative aspect of the subject matter described in this specification can be implemented in a multi-duct that is coupled to a surface of a cabinet including a plurality of spaces divided by one or more shelves in a refrigerator, the multi-duct comprising: a flow channel (i) that extends between a first end of the flow channel and a second end of the flow channel in a first direction, (ii) that passes through the plurality of spaces, and (iii) that guides cool air from the first end to the second end; an inlet that is located adjacent to the first end and through which cool air flows into the flow channel; a first side of the multi-duct that separates the plurality of spaces of the cabinet from the flow channel; and a plurality of outlets that are located at the first side of the multi-duct and that guide cool air from the flow channel to the plurality of spaces of the cabinet, wherein the flow channel includes a first curved flow channel (i) that is configured to discharge cool air through a first outlet of the plurality of outlets, the first outlet being located adjacent to the second end of the flow channel and (ii) that has a concave shape that is curved toward a second direction opposite to a direction in which cool air is discharged through the first outlet.

The foregoing and other implementations can each optionally include one or more of the following features, alone or in combination. In particular, one implementation includes all the following features in combination. The flow channel further includes: a second curved flow channel (i) that is configured to discharge cool air through a second outlet of the plurality of outlets, the second outlet being located adjacent to the second end of the flow channel and (ii) that has a concave shape that is curved toward a third direction opposite to a direction in which cool air is discharged through the second outlet, and wherein the curved portion of the first curved flow channel faces the curved portion of the second curved flow channel. The outlets are sequentially arranged in the first direction and includes a third outlet that is located adjacent to the first outlet, and wherein the third outlet includes a chamfer that has a slope relative to an inner surface of the flow channel. The first outlet extends between a third end and a fourth end in the first direction, and wherein the fourth end of the first outlet is aligned with the second end of the flow channel. The fourth end of the first outlet is continuously coupled to the second end of the flow channel. A width of the first outlet in a direction perpendicular to the first direction is substantially the same as a width of a portion of the flow channel in the direction perpendicular to the first direction, the portion of the flow channel being coupled to the first outlet. An inner surface of the first outlet is perpendicular to a plane of the multi-duct. The outlets are sequentially arranged in the first direction, and wherein a cross sectional area of each outlet of the plurality of outlets becomes greater as the outlet is closer to the second end of the flow channel. At least one of the plurality of outlets corresponds to each of the plurality of spaces of the cabinet.

In general, another innovative aspect of the subject matter described in this specification can be implemented in a multi-duct that is coupled to a surface of a cabinet including a plurality of spaces divided by one or more shelves in a refrigerator, the multi-duct comprising: a flow channel (i) that extends between a first end of the flow channel and a second end of the flow channel in a first direction, (ii) that passes through the plurality of spaces, and (iii) that guides cool air from the first end to the second end; an inlet that is located adjacent to the first end and through which cool air flows into the flow channel; a first side of the multi-duct that separates the plurality of spaces of the cabinet from the flow channel; and a plurality of outlets that are located at the first side of the multi-duct and that guide cool air from the flow channel to the plurality of spaces of the cabinet, wherein at least one of the plurality of outlets includes a chamfer that has a slope relative to an inner surface of the flow channel and that is continuously coupled to the inner surface of the flow channel.

The foregoing and other implementations can each optionally include one or more of the following features, alone or in combination. In particular, one implementation includes all the following features in combination. The first outlet extends between a third end and a fourth end in the first direction, and wherein the fourth end of the first outlet is aligned with the second end of the flow channel. The fourth end of the first outlet is continuously coupled to the second end of the flow channel. A width of the first outlet in a direction perpendicular to the first direction is substantially the same as a width of a portion of the flow channel in the direction perpendicular to the first direction, the portion of the flow channel being coupled to the first outlet. An inner surface of the outlet is perpendicular to a plane of the multi-duct. The outlets are sequentially arranged in the first direction, and wherein a cross sectional area of each outlet of the plurality of outlets becomes greater as the outlet is closer to the second end of the flow channel. At least one of the plurality of outlets corresponds to each of the plurality of spaces of the cabinet. The flow channel includes a curved flow channel (i) that is configured to discharge cool air through a first outlet of the plurality of outlets, the first outlet being located adjacent to the second end of the flow channel and (ii) that has a concave shape that is curved toward a second direction opposite to a direction that cool air is discharged through the first outlet.

In general, another innovative aspect of the subject matter described in this specification can be implemented in a refrigerator comprising: a cabinet that includes a plurality of spaces divided by one or more shelves; a multi-duct that is coupled to a surface of the cabinet and that includes: a flow channel (i) that extends between a first end of the flow channel and a second end of the flow channel in a first direction and (ii) that passes through the plurality of spaces, and (iii) through which cool air passes from the first end to the second end, an inlet that is located adjacent to the first end and through which cool air flows into the flow channel, a first side of the multi-duct that separates the plurality of spaces of the cabinet from the flow channel, and a plurality of outlets that are located at the first side of the multi-duct and through which cool air passes from the flow channel to the plurality of spaces of the cabinet, wherein the flow channel includes a curved flow channel (i) that is configured to discharge cool air through a first outlet of the plurality of outlets, the first outlet being located adjacent to the second end of the flow channel and (ii) that has a concave shape that is curved toward a second direction opposite to a direction that cool air is discharged through the first outlet; an evaporator that is configured to cool air and that is coupled to the inlet of the multi-duct; and a fan that is configured to provide cool air cooled by the evaporator to the inlet of the multi-duct, wherein the plurality of outlets are sequentially arranged in the first direction and at least one of the plurality of outlets corresponds to each of the plurality of spaces of the cabinet.

The foregoing and other implementations can each optionally include one or more of the following features, alone or in combination. In particular, one implementation includes all the following features in combination. The evaporator is located at a bottom side of the refrigerator relative to the multi-duct. The evaporator is disposed at a top side of the refrigerator relative to the multi-duct.

The subject matter described in this specification can be implemented in particular implementation so as to realize one or more of the following advantages. Comparing to a conventional refrigerator, a refrigerator comprises a multi-duct that can reduce temperature differences in an internal space of a refrigerator by controlling a flow direction and a discharging pattern of cool air. Thus, the multi-duct improves the power efficiency of the refrigerator.

The details of one or more implementations of the subject matter of this specification are set forth in the accompanying drawings and the description below. Other features, aspects, and advantages of the subject matter will become apparent from the description, the drawings, and the claims.

BRIEF DESCRIPTION OF DRAWINGS

FIG. 1 is a diagram illustrating an example multi-duct coupled to a cabinet of a refrigerator.

FIG. 2 is a diagram illustrating example flow and speed of air from a first outlet to a first space in a refrigerator.

FIG. 3 is a diagram illustrating an example flow and speed of air from a second outlet to a second space in a refrigerator.

FIGS. 4 to 10 are diagrams illustrating an example multi-duct coupled to a cabinet of a refrigerator.

FIG. 11 is a diagram illustrating example flow and speed of air from a first outlet to a first space in a refrigerator.

FIG. 12 is a diagram illustrating an example flow and speed of air from a second outlet to a second space in a refrigerator.

FIG. 13 is a diagram illustrating another example multi-duct.

FIG. 14 is a diagram illustrating another example multi-duct.

Like reference numbers and designations in the various drawings indicate like elements.

DETAILED DESCRIPTION

FIGS. 4 to 10 illustrate an example multi-duct coupled to a cabinet of a refrigerator.

In FIGS. 4 to 10, a rear side of a body 21 can be covered by a rear cover. In some implementations, the flow channel has a structure vertically connected while being blocked front, rear, left, and right.

A multi-duct can have a substantially flat shape having a suitable thickness. A multi-duct 10 includes a body including a flow channel 22 provided therein. In some implementations, a portion of the body around the flow channel 22 can be manufactured using an insulator such as EPS and the like and a cover formed of a synthetic resin material with adequate surface finishing may cover a front surface of the multi-duct (an opposite surface of a surface shown in the drawing).

In some implementations, a convex curve from both sides toward a center and the like may be applied to the front surface of the multi-duct. In some other implementations, the multi-duct can have a substantially flat shape.

The flow channel 22 is provided in a shape extending upward in the body 21 of the multi-duct 10. An inlet of the flow channel 22 is at a lower end in the drawings, and a terminal of the flow channel 22 is at an upper end in the drawings. An evaporator of the refrigerator is positioned upstream of the inlet of the flow channel 22 and cools air that circulates through an internal space of the refrigerator, and the air cooled by the evaporator flows into the inlet of the flow channel 22 through a pressurizer such as a fan and the like.

The air that flows into the flow channel 22 flows toward the terminal, that is, toward the upper part in the drawings along the flow channel 22. In this example, cool air is divided into and moves through two flow channels 221 and 222. For example, the first flow channel 221 and the second flow channel 222 are divided by a partition wall 23. In some implementations, the flow channel 22 is not divided. In some other implementations, the flow channel 22 can be divided three or more flow channels.

In the flow channels, a first outlet 41, a second outlet 42, a third outlet 43, and a fourth outlet 44 are provided in a direction from the terminal of the flow channel 22 to the inlet thereof and those outlets are provided from the flow channel 22 toward the front surface of the multi-duct while penetrating therethrough.

The outlets tray be provided according to a principle in which cross sectional areas become smaller when approaching the inlet of the flow channel and become larger when approaching the terminal of the flow channel. This is for moving the cool air that flows through the flow channel to be properly distributed and to flow into divided spaces 51, 52, 53, and 54 in a cabinet provided at positions corresponding to the respective outlets 41, 42, 43, and 44 and divided by a shelf installed in the cabinet, considering that a flow rate is higher and a flow pressure is higher when approaching the inlet of the flow channel.

In some implementations, in the multi-duct with the body 21 manufactured using an insulator, an inner wall of the outlet is generally formed of an insulator. Here, when the surface of the inner wall is well seen by people, it is apprehended that qualities of an external appearance thereof becomes deteriorated. Due to this, the inner wall of the outlet may be perpendicularly formed in front of a plane including the multi-duct so as not to be well seen by a person in front thereof when viewed from the front.

In some implementations, when the inner wall of the outlet is perpendicularly formed in front of the plane including the multi-duct as described above, the air discharged from the outlet has no choice but to be discharged substantially toward a perpendicular front in a shape corresponding to a cross section shape of the outlet (refer to FIG. 3). When the cool air discharged from the outlet moves toward only the perpendicular front as described above, since the cool air is drawn into a particular area in a corresponding one of the divided spaces divided by the shelf and does not reach another particular area, a temperature difference in the divided spaces becomes great and it is impossible to overcome the temperature difference by controlling an amount of the discharged cool air. Also, when the inner wall of the outlet is provided at an angle to change a direction in which the cool air is discharged, the quality of the external appearance may be deteriorated.

Accordingly, a structure in which a direction of the air discharged from the outlet is changed or the air is allowed to spread by changing a shape of the flow channel while the inner wall of the outlet is capable of remaining in a shape perpendicular to a planar part of the multi-duct is applied and a reduction of the temperature difference among the divided spaces is a technical concept thereof.

The fourth outlet 44 and the third outlet 43 have smaller cross sections compared with the second outlet 42 and the first outlet 41 and the inner wall of the outlet is provided perpendicular to the plane of the multi-duct. Since the fourth outlet 44 is closer to the inlet of the flow channel 22, a flow pressure of the cool air is higher than those of the outlets 41, 42, and 43. Accordingly, even though the cross sectional area of the outlet is narrow, since the cool air is discharged at a considerably high pressure into the fourth space, the flow of the cool air in the fourth space is adequate and a temperature difference in the fourth space does not become a big problem.

Even though the third outlet 43 next to the fourth outlet has a slightly larger cross sectional area than that of the fourth outlet, the inner wall of the outlet is still provided perpendicular to the plane of the multi-duct. Although not as close as the fourth outlet, since the third outlet 43 is still close to the inlet of the flow channel 22, the flow pressure of the cool air is still higher than other outlets 41 and 42 next thereto. Accordingly, only with a slightly larger cross sectional area than that of the fourth outlet 44, the cool air is well discharged into the third space 53 and a temperature difference in the third space is also insignificant.

Next, when the cool air moves along the flow channel and reaches the second outlet 42, since not only the cool air has already flowed in a considerable section of the flow channel but also there is a loss of the flow pressure through two outlets, the flow pressure may be decreased to a certain degree. In addition, since the first outlet is present next to the second outlet, all of the flow pressure near the second outlet is not discharged through the second outlet. Accordingly, a discharge pressure of the cool air of the second outlet 42 may be decreased compared with the third and fourth outlets. When the cross sectional area of the second outlet 42 is enlarged to provide the discharge pressure of the cool air, a large pressure drop occurs at the second outlet and the flow pressure of the cool air that reaches the first outlet may further drop.

Thus, with respect to a position of the second outlet, to move a considerable flow to the first outlet next thereto while the flow pressure drops to a certain degree, a chamfer 421 is formed at the second outlet to spread the air discharged to a second space 52 through the second outlet 42 as shown in FIG. 12. A difference between the discharged flows of the second outlet 42 with the chamfer 421 and the second outlet 42 without the chamfer 421 may be clearly recognized by comparing FIGS. 3 and 12.

Referring to FIGS. 7 and 9, the chamfer 421 may be formed with an incline between a part of the inner wall of the outlet at an upstream side of a flow direction, that is, a part of the inner wall close to the inlet of the flow channel and an inner wall of the flow channel. When the chamfer 421 is formed, an amount of a flow to the corresponding outlet through the chamfer 421 is further increased. Particularly, as shown in the drawings, since a flow rate of the cool air discharged through a central part of the cross sectional area of the outlet 42 is increased when the chamfer 421 has a slightly narrower width than a width of the outlet, the cool air discharged through the outlet 42 may widely spread as shown in FIG. 12.

According to the structure described above, there is provided an effect in which the pressure loss of the cool air that passes through the second outlet and flows toward the first outlet is reduced in the flow channel and the temperature difference in the second space 52 is also reduced.

The chamfer 421 may be formed only between the part of the inner wall of the outlet close to the inlet of the flow channel and the inner wall of the flow channel and may not be formed at another part of the inner wall. That is, the cool air that flows along the flow channel flows along the chamfer between the part of the inner wall close to the inlet of the flow channel and the inner wall of the flow channel toward the outlet. Here, when a chamfer incline is formed at the other part (that is, a left or right part or an upper part) of the inner wall, a phenomenon in which the cool air that flows along a downward chamfer groove toward the outlet returns to the flow channel along another chamfer may occur. This may cause a result in which only the flow pressure is lost while the discharge pressure of the corresponding outlet is not increased.

Even though the chamfer is formed, there is no difference of the external appearance seen from the outside through the outlet. Accordingly, it should be noted that the chamfer is used for widely spreading the air discharged through the outlet while maintaining the aesthetic quality of the external appearance.

Next, the first outlet 41 located at the terminal of the flow channel may be provided to have a much larger cross sectional area than those of other outlets. This is because it is preferable that the cool air that reaches the first outlet 41 at the terminal is discharged into the first space 51 through the first outlet 41 without flow loss.

To prevent the flow loss, the width of the first outlet 41 is allowed to be identical to widths of the flow channels 221 and 222. When the width of the first outlet 41 is larger than the width of the flow channel, it is aesthetically inferior because the surface of the flow channel is seen when viewed from the front. On the other hand, when the width of the first outlet 41 is smaller than the width of the flow channel, not only flow loss may occur hut also the discharge direction of the cool air discharged through the first outlet 41 may deviate in an undesirable direction. Considering a general first outlet shown in FIG. 1, since a first outlet 91 is biased inward while being narrower than a width of a flow channel 82, not only a flow loss occurs but also air discharged through the first outlet 91 is driven toward a center of the first space 51 as shown in FIG. 2 in such a way that a temperature difference in the first space 51 may be high.

On the other hand, when a width w1 of the first outlet 41 coincides with widths w2 of the flow channels 221 and 222 (refer to FIG. 8), not only a flow loss may be reduced but also a discharge direction of the cool air discharged through the first outlet may be clearly estimated and defined.

Next, to prevent a flow loss, as clearly shown in FIGS. 4 and 10, a longitudinal end section of the inner wall of the outlet 41 coincides with a longitudinal end section of the flow channel 22. In a general multi-duct shown in FIG. 1, since a top end of the flow channel 82 is higher than a top end of the first outlet 91, air flowing into a space between the top end of the first outlet 91 and the top end of the flow channel 82 generates an eddy and causes a loss of flow pressure.

In this example, since the top end of the first outlet 41 coincides with the top end of the flow channel 22, the top end of the flow channel may not be shown when viewed from the outside not to spoil an aesthetic quality and a pressure loss may be prevented.

In addition, in some implementations, a streamlined flow channel 24 is formed as a flow channel between the second outlet 42 and the first outlet 41, and more precisely, an end section of the flow channel starting from the first outlet 41 toward the second outlet 42, in a section that does not extend to the second outlet 42. The streamlined flow channel, as shown in the drawing, is a biased part curved leftward or rightward.

Even though the streamlined flow channel may be curved forward and backward, since this causes an increase of a forward and backward thickness of the overall multi-duct and leads to a loss of an internal storage space of the cabinet, the streamlined flow channel may be formed to be curved leftward and rightward. In some implementations, the streamlined flow channel can be curved forward and backward.

At the terminal of the flow channel, as described above, the width of the flow channel may be allowed to coincide with the width of the first outlet to prevent the flow loss. On the other hand, the velocity of the air discharged through the outlet may be slowed down as much as the width of the outlet that becomes larger as shown in the drawing. Accordingly, when the air discharged through the outlet exactly faces forward, due to the low discharge speed, an area to which the cool air is not evenly transferred may occur in the first space 51.

Accordingly, as shown in the drawing, the streamlined flow channels 24 formed at top ends of the two flow channels 221 and 222 adjacent to each other curve inward and then face outward. As described above, when the streamlined flow channels 24 are brought close to each other and then away from each other, the air discharged through the first outlet 41 is discharged slightly outward with a wide area as shown in FIG. 11, the cool air reaches the center of the first space 51 at the beginning of discharge and the cool air that collides with a door of the refrigerator smoothly flows toward a space in the rear along left and right inner walls of the cabinet. This is clearly distinguished from a flow of FIG. 2 in which flows of cool air fed toward the center mutually collide and a flow loss occurs in such a way that the cool air is not well transferred toward the back.

In the flow shown in FIG. 2, since a temperature of the center is considerably low and temperatures of left and right sides of the rear are relatively high, a temperature difference in a divided space is increased. On the other hand, in the flow as shown in FIG. 11, the cool air evenly spread toward a central part and left and right sides to notably decrease a temperature difference in a divided space.

Also, in the streamlined flow channel 24, like the chamfer 421, since there is no difference in external appearance seen from the outside through the outlet, it should be noted that a direction of air discharged through the outlet may be adjusted without deterioration of qualities of the external appearance.

In this example, since a flow direction or a spreading pattern of air discharged from the outlet may be controlled while the external appearance of the outlet remains neat, it is obvious that not only a difference between temperatures of divided spaces but also a temperature difference in a separately divided space may be decreased and accordingly the overall quality of the refrigerator may be improved.

In the example illustrated in FIG. 4, a structure in which an evaporator is positioned at a bottom of a rear side of the refrigerator and a multi-duct is installed thereabove is illustrated. The multi-duct described above can efficiently and evenly supplying cool air in a refrigerator having a shape with a small width and a vertically great height.

In some implementations, the multi-duct can be applied to not only to the refrigerator having the shape described above, but also a structure in which an evaporator is positioned at a top of a refrigerator and a multi-duct is installed therebelow; that is, an inlet of the multi-duct faces upward and a terminal of the multi-duct faces downward (a shape in which a multi-duct of FIG. 4 is upside-down) and it is obvious that an excellent effect in evenly supplying cool air is still exhibited in the structure described above.

FIG. 13 is a diagram illustrating another example multi-duct. Details regarding the multi-duct 10 in FIG. 13 can be the same as the multi-duct described with reference to FIGS. 4 to 10 except the following differences. For example, the internal space can be divided into three spaces by shelves.

In some implementations, the number of divided spaces can be reduced to 3 and the number of outlets can be reduced by one, e.g., the first outlet 41, the second outlet 42, and the third outlet 43.

In some implementations, the third outlet 43 and the second outlet 42 of the multi-duct can be formed the same as the fourth outlet and the third outlet described with reference to FIGS. 4 to 10. That is, the third outlet 43 has the smallest cross sectional area and the second outlet 42 has a cross sectional area larger than the third outlet 43.

In some implementations, the cross sectional area of the third outlet in this example can be larger than the cross sectional area of the fourth outlet in the example described with reference to FIGS. 4 to 10. In addition, the cross sectional area of the second outlet in this example can be larger than the cross sectional area of the third outlet of the example described with reference to FIGS. 4 to 10. Also, a difference may be present between rates of increasing cross sectional areas.

In this example, regarding flow in the flow channel 22, since there is only the third outlet as an outlet present before the second outlet, a flow pressure of cool air around the second outlet may be adequate. Accordingly, in the multi-duct configured as three stages, a chamfer structure may not be applied to the second outlet 42.

Other details of the first outlet 41 and the flow channel 24 with a streamlined flow channel part can be the same as the example described with reference to FIGS. 4 to 10.

As described above, the streamlined flow channel 24 and the chamfer 421 can be determined based on the number of stages of divided spaces divided by shelves, a length of a multi-duct, a flow pressurizing ability of a fan and the like.

FIG. 14 illustrates another example multi-duct. Details of the multi-duct of FIG. 14 can be the same as the example described with reference to FIGS. 4 to 10 except the following differences including that the flow channel 22 is not branched by a partition wall 23 and extends as one flow channel.

In this example, comparing to the example described with reference to FIGS. 4 to 10, each of the second to fourth outlets 42, 43, and 44 are formed in the branched flow channels 221 and 222 as one pair respectively or fondled in the unbranched flow channel 22 one by one. Other details such as sizes or positions of cross sectional areas can be the same as the example described with reference to FIGS. 4 to 10.

In this example, the flow channel 22 is not branched. Thus, a chamfer 411 is disposed at a center of the bottom of the first outlet 41 to allow cool air discharged from the first outlet 41 to also spread. This is different from the examples described with reference to FIGS. 4 and 13 where the streamlined flow channel 24 is formed to discharge cool air discharged from the first outlet in a widespread direction.

When a partition wall is disposed between the first outlet and the second outlet, above the second outlet, to branch the flow channel after the second outlet, that is, when a structure in which a partition wall starts from above the second outlet is applied to the example described with reference to FIG. 13, a structure for allowing cool air discharged from the first outlet to widely spread by forming the streamlined flow channel 24 may be applied in the examples described with reference to FIGS. 4 and 13.

In this example, a chamfer can be applied not only to the second outlet but also to the first outlet.

What is claimed is:

1. A multi-duct that is coupled to a surface of a cabinet including a plurality of spaces divided by one or more shelves in a refrigerator, the multi-duct comprising:

a flow channel (i) that extends between a first end of the flow channel and a second end of the flow channel in a first direction, (ii) that passes through the plurality of spaces, and (iii) that guides cool air from the first end to the second end;

an inlet that is located adjacent to the first end and through which cool air flows into the flow channel;

a first side of the multi-duct that separates the plurality of spaces of the cabinet from the flow channel; and a plurality of outlets that are located at the first side of the multi-duct and through which cool air is guided from the flow channel to the plurality of spaces of the cabinet, wherein the flow channel includes a first curved flow channel (i) that is configured to discharge cool air through a first outlet of the plurality of outlets, the first outlet being located adjacent to the second end of the flow channel and (ii) that has a concave shape that is curved toward a second direction opposite to a direction in which cool air is discharged through the first outlet.

2. The multi-duct of claim 1, wherein the flow channel further includes:

a second curved flow channel (i) that is configured to discharge cool air through a second outlet of the plurality of outlets, the second outlet being located adjacent to the second end of the flow channel and (ii) that has a concave shape that is curved toward a third direction opposite to a direction in which cool air is discharged through the second outlet, and wherein the curved portion of the first curved flow channel faces the curved portion of the second curved flow channel.

3. The multi-duct of claim 1, wherein the outlets are sequentially arranged in the first direction and includes a third outlet that is located adjacent to the first outlet, and wherein the third outlet includes a chamfer that has a slope relative to an inner surface of the flow channel.

4. The multi-duct of claim 1, wherein the first outlet extends between a third end and a fourth end in the first direction, and wherein the fourth end of the first outlet is aligned with the second end of the flow channel.

5. The multi-duct of claim 4, wherein the fourth end of the first outlet is continuously coupled to the second end of the flow channel.

6. The multi-duct of claim 1, wherein a width of the first outlet in a direction perpendicular to the first direction is substantially the same as a width of a portion of the flow channel in the direction perpendicular to the first direction, the portion of the flow channel being coupled to the first outlet.

7. The multi-duct of claim 1, wherein an inner surface of the first outlet is perpendicular to a plane of the multi-duct.

8. The multi-duct of claim 1, wherein the outlets are sequentially arranged in the first direction, and wherein a cross sectional area of each outlet of the plurality of outlets becomes greater as the outlet is closer to the second end of the flow channel.

9. The multi-duct of claim 8, wherein at least one of the plurality of outlets corresponds to each of the plurality of spaces of the cabinet.

10. A multi-duct that is coupled to a surface of a cabinet including a plurality of spaces divided by one or more shelves in a refrigerator, the multi-duct comprising:

a flow channel (i) that extends between a first end of the flow channel and a second end of the flow channel in a first direction, (ii) that passes through the plurality of spaces, and (iii) that guides cool air from the first end to the second end;

an inlet that is located adjacent to the first end and through which cool air flows into the flow channel;

a first side of the multi-duct that separates the plurality of spaces of the cabinet from the flow channel; and a plurality of outlets that are located at the first side of the multi-duct and through which cool air is guided from the flow channel to the plurality of spaces of the cabinet, wherein at least one of the plurality of outlets includes a chamfer that has a slope relative to an inner surface of the flow channel and that is continuously coupled to the inner surface of the flow channel, and wherein the flow channel includes a curved flow channel (i) that is configured to discharge cool air through a first outlet of the plurality of outlets, the first outlet being located adjacent to the second end of the flow channel and (ii) that has a concave shape that is curved toward a second direction opposite to a direction that cool air is discharged through the first outlet.

11. The multi-duct of claim 10, wherein the first outlet extends between a third end and a fourth end in the first direction, and wherein the fourth end of the first outlet is aligned with the second end of the flow channel.

12. The multi-duct of claim 11, wherein the fourth end of the first outlet is continuously coupled to the second end of the flow channel.

13. The multi-duct of claim 10, wherein a width of the first outlet in a direction perpendicular to the first direction is substantially the same as a width of a portion of the flow channel in the direction perpendicular to the first direction, the portion of the flow channel being coupled to the first outlet.

14. The multi-duct of claim 10, wherein an inner surface of the outlet is perpendicular to a plane of the multi-duct.

15. The multi-duct of claim 10, wherein the outlets are sequentially arranged in the first direction, and wherein a cross sectional area of each outlet of the plurality of outlets becomes greater as the outlet is closer to the second end of the flow channel.

16. The multi-duct of claim 15, wherein at least one of the plurality of outlets corresponds to each of the plurality of spaces of the cabinet.

17. A refrigerator comprising:

a cabinet that includes a plurality of spaces divided by one or more shelves;

a multi-duct that is coupled to a surface of the cabinet and that includes:

a flow channel (i) that extends between a first end of the flow channel and a second end of the flow channel in a first direction and (ii) that passes through the plurality of spaces, and (iii) through which cool air passes from the first end to the second end, an inlet that is located adjacent to the first end and through which cool air flows into the flow channel, a first side of the multi-duct that separates the plurality of spaces of the cabinet from the flow channel, and a plurality of outlets that are located at the first side of the multi-duct and through which cool air passes from the flow channel to the plurality of spaces of the cabinet, wherein the flow channel includes a curved flow channel (i) that is configured to discharge cool air through a first outlet of the plurality of outlets, the first outlet being located adjacent to the second end of the flow channel and (ii) that has a concave shape that is curved toward a second direction opposite to a direction that cool air is discharged through the first outlet;

an evaporator that is configured to cool air and that is coupled to the inlet of the multi-duct; and a fan that is configured to provide cool air cooled by the evaporator to the inlet of the multi-duct, wherein the plurality of outlets are sequentially arranged in the first direction and at least one of the plurality of outlets corresponds to each of the plurality of spaces of the cabinet.

18. The refrigerator of claim 17, wherein the evaporator is located at a bottom side of the refrigerator relative to the multi-duct.

19. The refrigerator of claim 17, wherein the evaporator is disposed at a top side of the refrigerator relative to the multi-duct.

* * * * *